US007316467B2

(12) United States Patent
Toki

(10) Patent No.: US 7,316,467 B2
(45) Date of Patent: Jan. 8, 2008

(54) INK JET RECORDING APPARATUS HAVING MULTI-LAYER WASTE INK ABSORBER

(75) Inventor: Nobuhiro Toki, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/535,316

(22) Filed: Sep. 26, 2006

(65) Prior Publication Data

US 2007/0076046 A1 Apr. 5, 2007

(30) Foreign Application Priority Data

Oct. 3, 2005 (JP) ..... 2005-290037

(51) Int. Cl.
*B41J 2/165* (2006.01)

(52) U.S. Cl. ..... 347/36; 347/31; 347/35

(58) Field of Classification Search ..... 347/31, 347/33, 35, 36; 442/392
See application file for complete search history.

(56) References Cited

U.S. PATENT DOCUMENTS 5,172,140 A 12/1992 Hirabayashi et al.
5,245,362 A 9/1993 Iwata et al.
5,357,275 A * 10/1994 Ikado et al. ..... 347/31
6,860,583 B2 * 3/2005 Cheney et al. ..... 347/35
6,910,757 B2 * 6/2005 Kanamitsu et al. ..... 347/31
7,073,887 B2 * 7/2006 Yoshida ..... 347/36

FOREIGN PATENT DOCUMENTS

JP 07-57547 6/1995
JP 63-61182 11/1998

* cited by examiner

*Primary Examiner*—Shih-Wen Hsieh
(74) *Attorney, Agent, or Firm*—Fitzpatrick, Cella, Harper & Scinto

(57) ABSTRACT

A waste ink container of an ink jet recording apparatus includes a plurality of ink-retrieving absorbers and a connecting absorber connecting the ink-retrieving absorbers. The ink-retrieving absorbers have a multilayer structure including a plurality of layers of absorbing members. The connecting absorber has bent portions. The ink-retrieving absorbers have holes formed therein. The bent portions are inserted into the holes so as to be in contact with the layers of absorbing members of the ink-retrieving absorbers.

23 Claims, 8 Drawing Sheets

INK JET RECORDING APPARATUS HAVING MULTI-LAYER WASTE INK ABSORBER

BACKGROUND OF THE INVENTION

1. Field of the Invention

The present invention relates to an ink jet recording apparatus including an ink absorber for retrieving or retaining waste ink that is not used in image recording.

2. Description of the Related Art

Many recording apparatuses that form (record) an image on a recording medium such as recording paper on the basis of image information are used as photocopiers, facsimiles, and printers. The recording apparatuses employ various recording technologies. Among them, an ink jet recording technology is a low-noise and non-impact recording technology. In the ink jet recording technology, ink is discharged from discharge ports of a recording head serving as a recording device, and recording is thereby performed. In the ink jet recording technology, ink is directly attached to a recording medium such as paper, cloth, non-woven cloth, or an OHP sheet. Ink jet recording apparatuses employing such a recording technology have the advantage that a high-density and high-speed recording operation can be performed.

Generally, ink jet recording apparatuses are configured to discharge ink droplets from minute discharge ports formed in a recording head, to attach the ink droplets to a recording medium, and thereby to perform dot recording. Therefore, bubbles and dust can enter the discharge ports, and ink can be thickened due to evaporation of ink solvent. Such can cause defective discharge of ink and can thereby deteriorate image quality. In order to eliminate these causes of defective discharge, a discharge recovery process is performed. In the process, the ink in the recording head is refreshed, and normal ink-discharging function is thereby maintained or recovered.

As a form of this recovery device (or recovery unit) that performs discharge recovery process, there is a recovery device including a cap and a pump. The cap is capable of covering a discharge port surface of a recording head in which discharge ports are formed. The pump communicates with the cap and exerts a sucking force. The recovery device exerts the sucking force in a capping state, i.e., with the cap attached to the discharge port surface, thereby forcibly discharging ink from the discharge ports. This process is called a suction recovery process. The recording device also performs ink discharge not effecting recording (preliminary discharge) with the cap or an ink receiver opposite the discharge port surface. This process is called a pressurization recovery process. These processes are for removing the causes of defective discharge such as bubbles and dust, together with ink. As disclosed in Japanese Patent Publication No. 63-61182, ink jet recording apparatuses generally have a waste ink absorber disposed in the apparatus body for accumulating waste ink produced in the discharge recovery process.

However, in ink jet recording apparatuses, the number of necessary recovery processes and the amount of ink discharged in each recovery process differ according to use, frequency of use, or product life of the apparatus. That is to say, ink jet recording apparatuses that discharge a large amount of ink in the recovery process require a capacious waste ink absorber, and such a waste ink absorber occupies a large space in the apparatus. On the other hand, ink jet recording apparatuses have been reduced in size, and various measures have been taken in order to secure a space for the waste ink absorber without increasing the size of the apparatus.

For example, U.S. Pat. No. 5,245,362 discloses a waste ink absorbing structure including a first absorbing member for containing waste ink, and a second absorbing member connected to the first absorbing member via a tube. When the amount of waste ink exceeds the capacity of the first absorbing member, the overflow is introduced into the second absorbing member. In addition, U.S. Pat. No. 5,172,140 discloses a recording apparatus having different waste ink absorbing members disposed in the spaces on either side of a recording sheet conveying section, which are normally empty spaces in the recording apparatus body.

Moreover, Japanese Patent Publication No. 7-57547 discloses a waste ink absorber having a multilayer structure including a plurality of ink absorbing members. This multilayer absorber can absorb and hold more waste ink than a single absorber of the same volume. The reason is that, due to the multilayer structure, interlayer gaps between the layers of absorbing members function as ink holding areas. In addition, in the multilayer waste ink absorber, the layers of absorbing members support each other. Therefore, the waste ink absorber is improved in resistance to collapse or compression due to its own weight, and unintended ink outflow from the waste ink absorber can be prevented.

However, the above known ink jet recording apparatuses including a waste ink absorber have the following problems. In the case of U.S. Pat. No. 5,245,362, the addition of connecting parts complicates the apparatus structure and increases the production cost.

In the case of U.S. Pat. No. 5,172,140, when the discharge recovery process is performed continuously and a large amount of waste ink is discharged at a time, the waste ink absorber can fail to absorb all of the waste ink. Therefore, at the worst, the waste ink can leak from the recording apparatus. The reason is that it takes a long time for the waste ink to spread from one absorbing member to another absorber.

In the case of Japanese Patent Publication No. 7-57547, indeed the absorption capacity can be increased, but since the interlayer spread of the waste ink is slow, ink absorption can fail to keep up with the ink discharge. Therefore, the waste ink absorber can fail to absorb all of the waste ink, and at the worst, the waste ink can leak from the recording apparatus.

SUMMARY OF THE INVENTION

The present invention provides an ink jet recording apparatus including a waste ink container that has a capacity increased without increasing the recording apparatus in size and that, even when a large amount of waste ink is discharged at a time, can absorb the waste ink in a short time.

In an aspect of the present invention, an ink jet recording apparatus discharges ink from a recording device onto a recording medium and thereby performs recording. The ink jet recording apparatus includes a recovery device, a first absorber, a second absorber, and a connecting absorber. The recovery device is for maintaining or recovering an ink-discharging function of the recording device. The first absorber absorbs waste ink discharged from the recovery device. The second absorber is disposed apart from the first absorber and absorbs the waste ink. The connecting absorber transmits ink from the first absorber to the second absorber. The connecting absorber is in contact with at least one fast surface of the first absorber, through which ink spreads faster than ink spreads in other surfaces of the first absorber.

In another aspect of the present invention, an ink jet recording apparatus that discharges ink from a recording device onto a recording medium and thereby performs recording includes recovery means, first absorbing means, second absorbing means and connecting absorbing means. The recovery means maintains or recovers an ink-discharging function of the recording device. The first absorbing means absorbs waste ink discharged from the recovery means. The second absorbing means is disposed apart from the first absorbing means and absorbs the waste ink. The connecting absorbing means transmits ink from the first absorbing means to the second absorbing means. The connecting absorbing means is in contact with a fast surface of the first absorbing means, through which ink spreads faster than ink spreads in other surfaces of the first absorbing means.

Further features of the present invention will become apparent from the following description of exemplary embodiments (with reference to the attached drawings).

DESCRIPTION OF THE EMBODIMENTS

Figure 1:
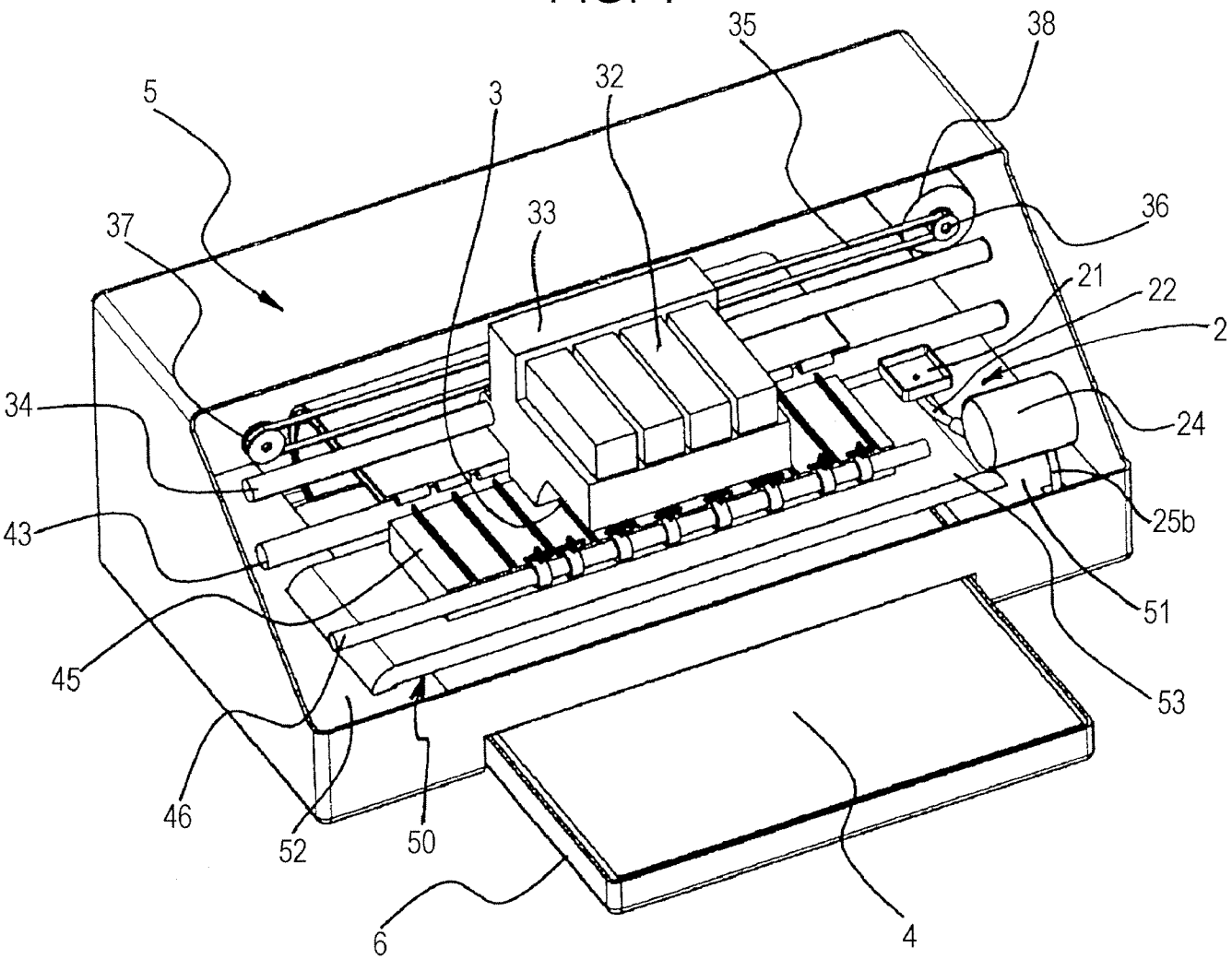
FIG. 1 is a perspective view showing an embodiment of an ink jet recording apparatus to which the present invention is applied.
Figure 2:
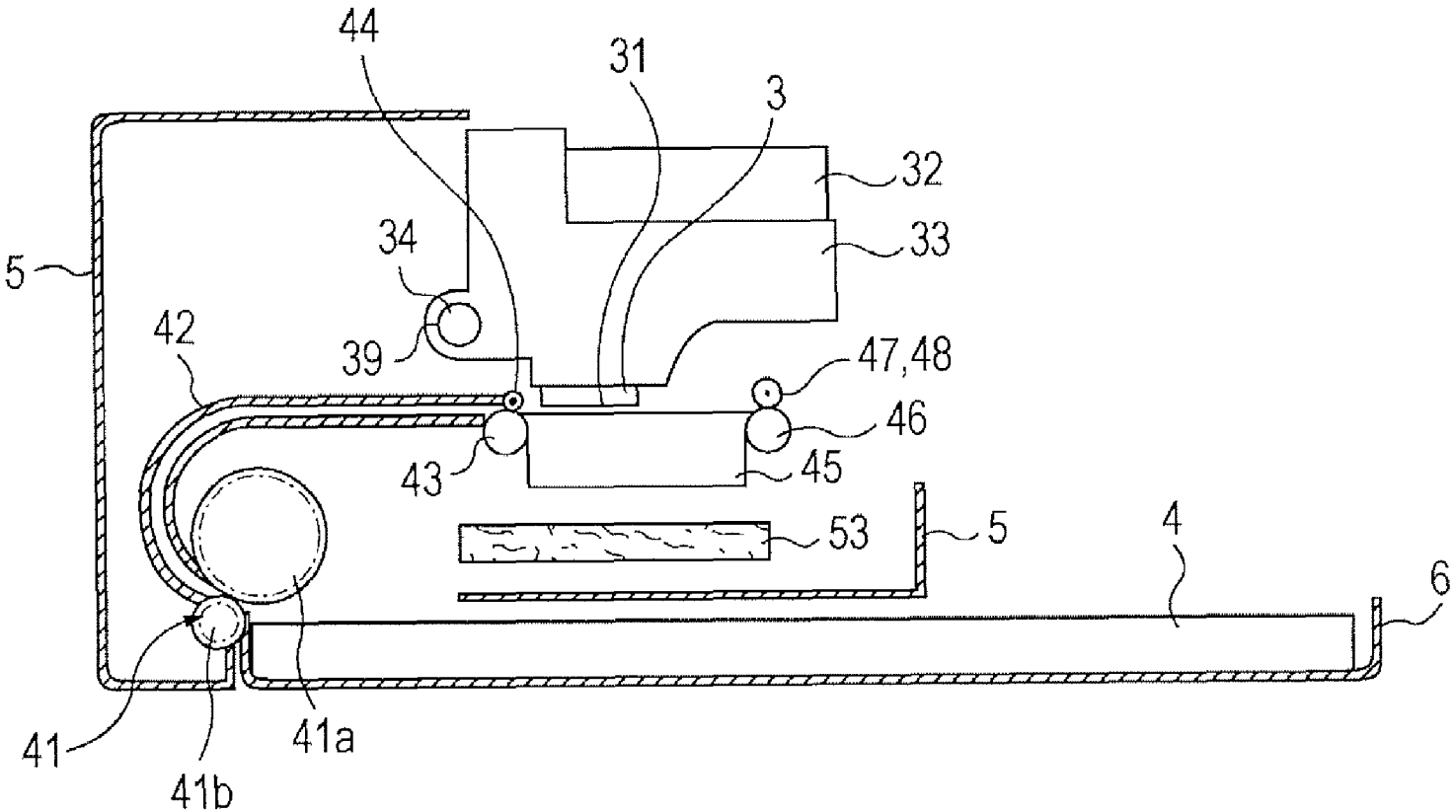
FIG. 2 is a vertical sectional view of the central part of the ink jet recording apparatus of FIG. 1.
Figure 3:
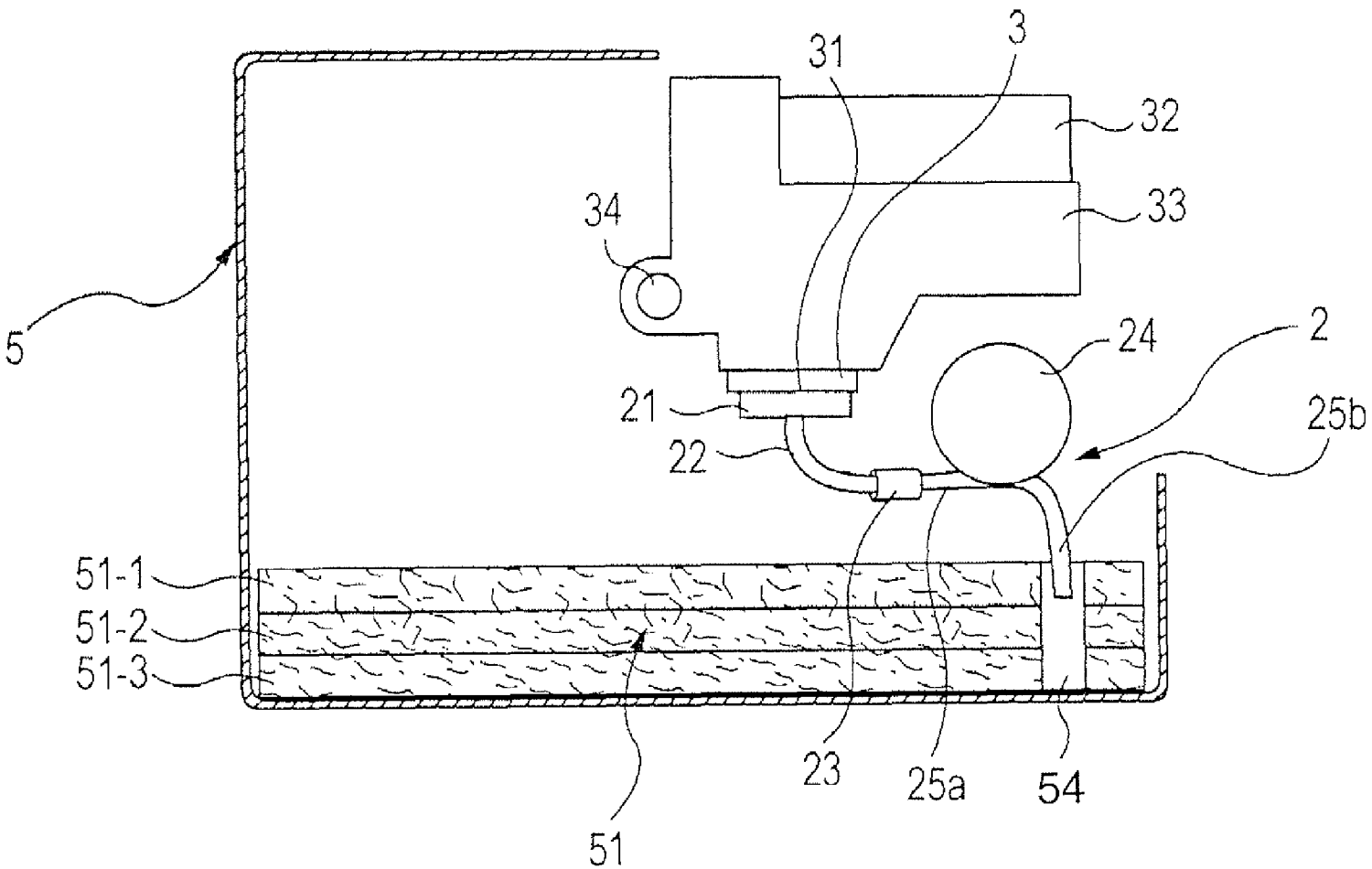
FIG. 3 is a vertical sectional view showing a recovery device of the ink jet recording apparatus of FIG. 1.
Figure 4:
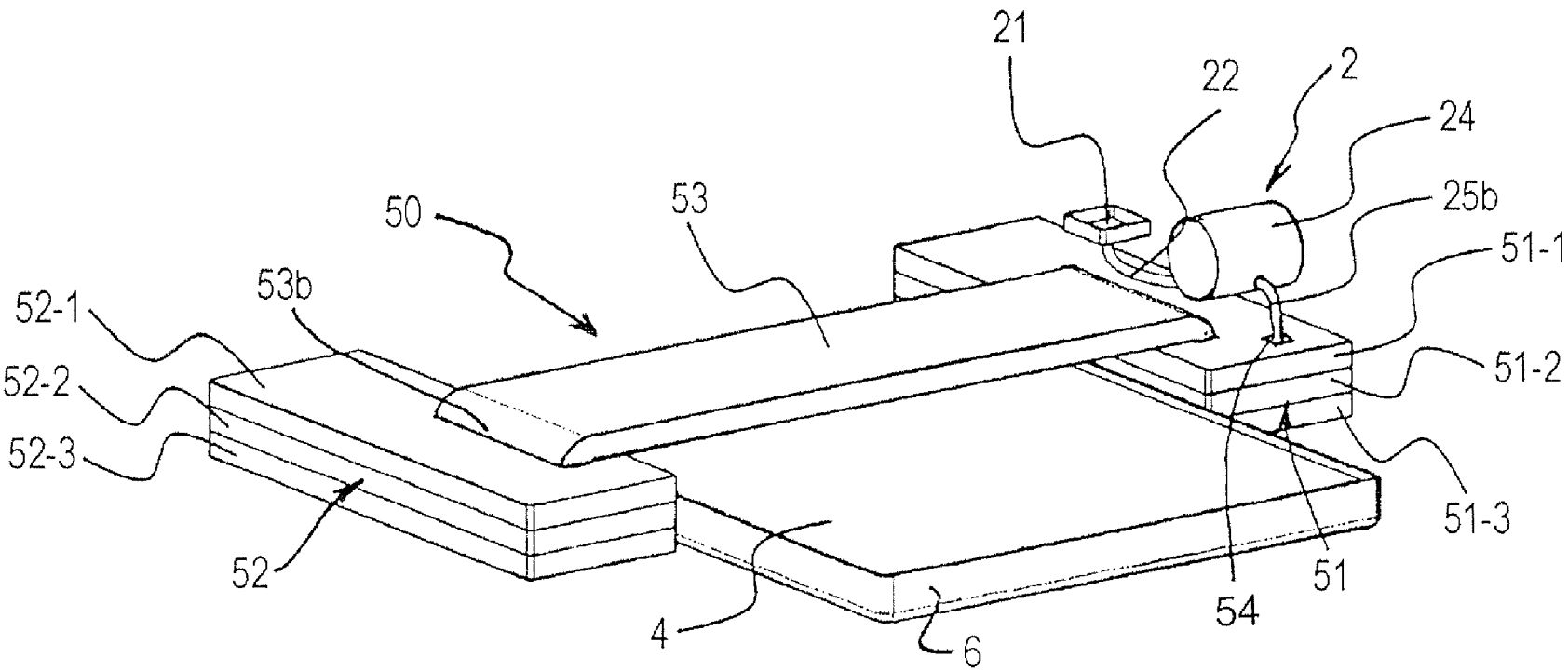
FIG. 4 is a perspective view showing a waste ink container of an embodiment of an ink jet recording apparatus to which the present invention is applied.

The embodiments of the present invention will now be described with reference to the drawings. In the figures, the same reference numerals are used to designate the same or corresponding components. FIG. 1 is a perspective view showing an embodiment of an ink jet recording apparatus to which the present invention is applied. FIG. 2 is a vertical sectional view of the central part of the ink jet recording apparatus of FIG. 1. FIG. 3 is a vertical sectional view showing a recovery device of an ink jet recording apparatus according to an embodiment. FIG. 4 is a perspective view showing a waste ink container of an embodiment of an ink jet recording apparatus to which the present invention is applied.

In FIGS. 1 and 2, a mechanical section of the recording apparatus is placed in a case 5 of an apparatus body. In the front of the case 5, a cassette 6 is detachably mounted. The cassette 6 contains sheets 4 of recording paper serving as recording media. The uppermost one of the sheets 4 in the cassette 6 is separated by a feeding device 41 including a feeding roller 41*a* and a separating roller 41*b*. The separated sheet is fed (conveyed) to a conveying device including a conveying roller 43 and a pinch roller 44 through a sheet guiding path 42. The sheet is then conveyed through an image forming section by the conveying device (43 and 44) and a discharge device driven in synchronization therewith. The discharge device includes a discharge roller 46 and a spur 47. The spur 47 is supported rotatably and urged to the discharge roller 46 by a spring shaft 48.

The image forming section between the conveying device (43 and 44) and the discharge device (46 and 47) is provided with a carriage 33. The carriage 33 has a recording head 3 mounted thereon and reciprocates along the sheet 4. The recording head 3 discharges ink onto a recording medium (sheet) on the basis of recording information, thereby recording an image. The recording head 3 has a discharge surface 31 provided on the front surface thereof (on the undersurface thereof in the shown example). In the discharge surface 31, discharge ports that discharge ink droplets are arranged. Opposite the discharge surface 31 of the recording head 3, a platen 45 is disposed. The platen 45 is for guiding and supporting the sheet being subjected to image recording.

The pinch roller 44 is pressed against the conveying roller 43 by an urging force of a pinch roller spring (not shown). The pinch roller 44, being driven by the rotation of the conveying roller 43, rotates and generates a force to convey the sheet 4. The spur 47 is pressed against the discharge roller 46 by an urging force of a spring shaft 48 attached to a spur holder (not shown). The spur 47, being driven by the rotation of the discharge roller 46, rotates and generates a force to convey the sheet 4.

The carriage 33 has a replaceable ink tank 32 mounted thereon for supplying ink to the recording head 3. A horizontally extending guide shaft 34 is fixed to the apparatus body. The carriage 33 is fitted to the guide shaft 34 via a bearing 39, thereby being guided and supported slidably. An endless timing belt 35 joined to the carriage 33 is extended around a motor pulley 36 and an idler pulley 37. By rotating the motor pulley 36 with a carriage motor 38, the carriage 33 is reciprocated.

The recording head 3 discharges ink on the basis of recording information in synchronization with a main scan of the recording head 3 driven by the carriage motor 38, thereby performing a line of recording. After a line of recording is finished, the sheet is conveyed (sub-scanned) by a predetermined pitch by the conveying device (43 and 44), and then the next line of recording is performed. By alternately repeating such a line of recording and the paper feeding by a predetermined pitch, image recording is performed on the entire sheet. The sheet on which an image is recorded is discharged, through the discharge device (46 and 47), onto a discharge tray (not shown) provided outside the apparatus body.

The recording head 3 has a plurality of minute discharge ports formed in the discharge surface 31 thereof and arranged in a predetermined pattern. By selectively driving energy generators (e.g., heater elements) provided in the discharge ports (or specifically in liquid paths leading to the discharge ports), the recording head 3 discharges ink droplets. Ink jet recording apparatuses use the following energy-generating technologies. A technology heats ink with an electrothermal converter such as a heating element, thereby discharging ink droplets. Another technology expands an electromechanical converter such as a piezoelectric element, thereby discharging ink droplets. Another technology heats ink by irradiating with electromagnetic waves from a source such as a laser, thereby discharging ink droplets.

The recording technologies that discharge ink droplets by utilizing thermal energy are particularly capable of high-resolution image recording because the ink discharge ports can be arranged in high density. Among them, the recording head that uses electrothermal converters as energy generators can be reduced in size with ease, and can be manufactured in high density with ease by making full use of the advantages of the IC technology and the micro-processing technology, which have made remarkable technical advancement in the semiconductor field.

As shown in FIG. 1, a recovery device 2 for maintaining or recovering the ink-discharging function of the recording head 3 is disposed at a position adjacent a recording area (an area through which paper passes) in the apparatus body. The recovery device 2 is normally unitized. In FIGS. 1, 3, and 4, the recovery device 2 has a cap 21 detachably attached to the discharge surface 31 of the recording head 3. The cap 21 is closely attached to the discharge surface 31, thereby covering the discharge ports. The primary function of the cap 21 is to cap (cover) the discharge ports when recording is not performed, thereby to protect the discharge ports, and additionally to prevent ink in the discharge ports from evaporating. The cap 21 is formed of an elastic material such as rubber, and has a sealing rib formed on the edge of the front opening thereof.

A cap tube 22 connected to the cap 21 is connected to an entrance tube 25*a* of a suction pump 24 via a joint 23. By activating the suction pump 24, the waste ink discharged into the cap 21 passes through the cap tube 22, the entrance tube 25*a*, and the suction pump 24, and is introduced (discharged) from the exit tube 25*b* of the suction pump 24 to a waste ink container 50, which will hereinafter be described. The cap 21 and the suction pump 24 are also used in a suction recovery process or a pressurization recovery process, which is a recovery process for refreshing ink in the discharge ports.

In the suction recovery process, the cap 21 is closely attached to the discharge surface 31 so as to seal the discharge ports. By activating the suction pump 24, ink including bubbles, dust, and thickened ink in the discharge ports is forcibly sucked and discharged. The ink in the discharge ports is thereby refreshed. The sucked waste ink is discharged from the exit tube 25*b*. In the pressurization recovery process, the recording head 3 is driven to perform ink discharge not effecting recording (preliminary discharge) with the discharge surface 31 opposite the cap 21 or an ink receiver. The ink in the discharge ports is thereby refreshed. In the pressurization recovery process, by activating the suction pump 24, the waste ink discharged into the cap 21 is discharged from the exit tube 25*b*. As the suction pump 24, various forms of pumps can be used, as long as they are pumps that generate negative pressure. In this embodiment, as the suction pump 24, a tube pump is used. The tube pump generates negative pressure by collapsing a flexible tube communicating with the cap 21 with a roller.

As shown in FIGS. 1 and 4, a waste ink container 50 is disposed inside the apparatus body. The waste ink container 50 is formed of a superabsorbent material. The waste ink container 50 includes a plurality of ink-retrieving absorbers 51 and 52 and a connecting absorber 53 that connects the ink-retrieving absorbers 51 and 52. The connecting absorber 53 has bent portions 53*a* and 53*b* formed at both ends thereof. The bent portions 53*a* and 53*b* are in contact with the ink-retrieving absorbers 51 and 52. That is to say, in this embodiment, the recovery device 2 is disposed at one end of the apparatus body (on the right side in the figures), one of the two absorbers 51 and 52 (first absorber 51) is disposed near the recovery device 2, and the other absorber (second absorber 52) is disposed on the opposite side from the recovery device 2 (on the left side in the figures). The absorbers 51 and 52 are connected by the connecting absorber 53. The absorber 53 is disposed across the cassette 6 attached near the bottom of the apparatus body.

In this embodiment, the ink-retrieving absorbers 51 and 52 are held in container portions formed near the bottom of the case 5 of the apparatus body. As shown in FIGS. 1, 3, and 4, the first absorber 51 that is disposed near the recovery device 2 has a waste-ink receiving hole 54 formed therein and extending vertically. The tip of the exit tube 25*b*is inserted into the waste-ink receiving hole 54, and the waste ink sucked by the suction pump 24 is first absorbed by the first absorber 51. The ink-retrieving absorbers 51 and 52 have a multilayer structure including a plurality of layers of absorbing members. Specifically, the first absorber 51 has a three-layer structure including first, second, and third layers of absorbing members 51-1, 51-2, and 51-3. The second absorber 52 also has a three-layer structure including first, second, and third layers of absorbing members 52-1, 52-2, and 52-3. In this embodiment, the waste-ink receiving hole 54 is formed through all of the layers of absorbing members 51-1, 51-2, and 51-3 and reaches the bottom surface of the container portion formed by the case 5. For these absorbing members, the surfaces parallel to the bottom surface of the container portion are surfaces through which ink spreads relatively slowly. In contrast, the surfaces in the thickness direction of the retrieving absorbing members are surfaces through which ink spreads relatively fast. The ink-retrieving absorbers 51 and 52 are formed of pulp fibers bound with a fibrous adhesive or a powdered adhesive. In addition, the ink-retrieving absorbers may have a pulp nonwoven fabric attached to the surface layer thereof. The ink-retrieving absorbers are pressed in the thickness direction so as to be formed into a sheet-like shape. Therefore, the direction of the pulp fibers is substantially perpendicular to the thickness direction. Due to capillary phenomenon, ink spreads fast in the direction along the direction of the pulp fibers. Therefore, in the ink-retrieving absorbers, ink spreads faster in the direction perpendicular to the thickness direction than in the thickness direction. The ink-retrieving absorbers are press-cut or stamped out of a sheet-like absorber into a desired shape. Therefore, at the cut surface, the surface through which ink spreads fast is exposed. By spreading ink through this surface, a faster ink spread can be obtained.

The ink-retrieving absorbers 51 and 52 having a multilayer structure including a plurality of layers of absorbing members have the following advantages. First, since the layers of absorbing members constituting the multilayer structure support each other, the absorber is improved in resistance to collapse or compression due to its position or own weight, and therefore unintended ink outflow from the absorber can be prevented. Second, in the case where the absorber is divided into sections and has a multilayer structure, the absorber can be shaped more flexibly than in the case where the absorber is processed as a single large piece. Therefore, by shaping the absorber along the inner surface of the container portion, the apparatus can be reduced in size with ease. In this case, as the absorbing members, ones formed by compression-molding a fiber assembly such as pulp are widely used. Specifically, the absorbing members are formed by being stamped out of a compression-molded plate into a necessary shape with a pressing machine. Therefore, compared to forming the absorber as a single large piece with a pressing machine, forming the absorber by laminating a plurality of layers of absorbing members formed with a pressing machine is advantageous in terms of processability, flexibility of shape, and reduction in size.

The connecting absorber 53 of this embodiment does not have a multilayer structure and is formed of a single absorbing member. The connecting absorber 53 has bent portions 53*a* and 53*b* formed at both ends thereof. By bringing the bent portions 53*a* and 53*b* into contact with at least one of the absorbing members constituting the corresponding absorbers 51 and 52, the absorber 53 is connected to the absorbers 51 and 52. The embodiments of the configuration of the joints between the connecting absorber 53 and the ink-retrieving absorbers 51 and 52 will hereinafter be described.

Embodiment 1

Figure 5:
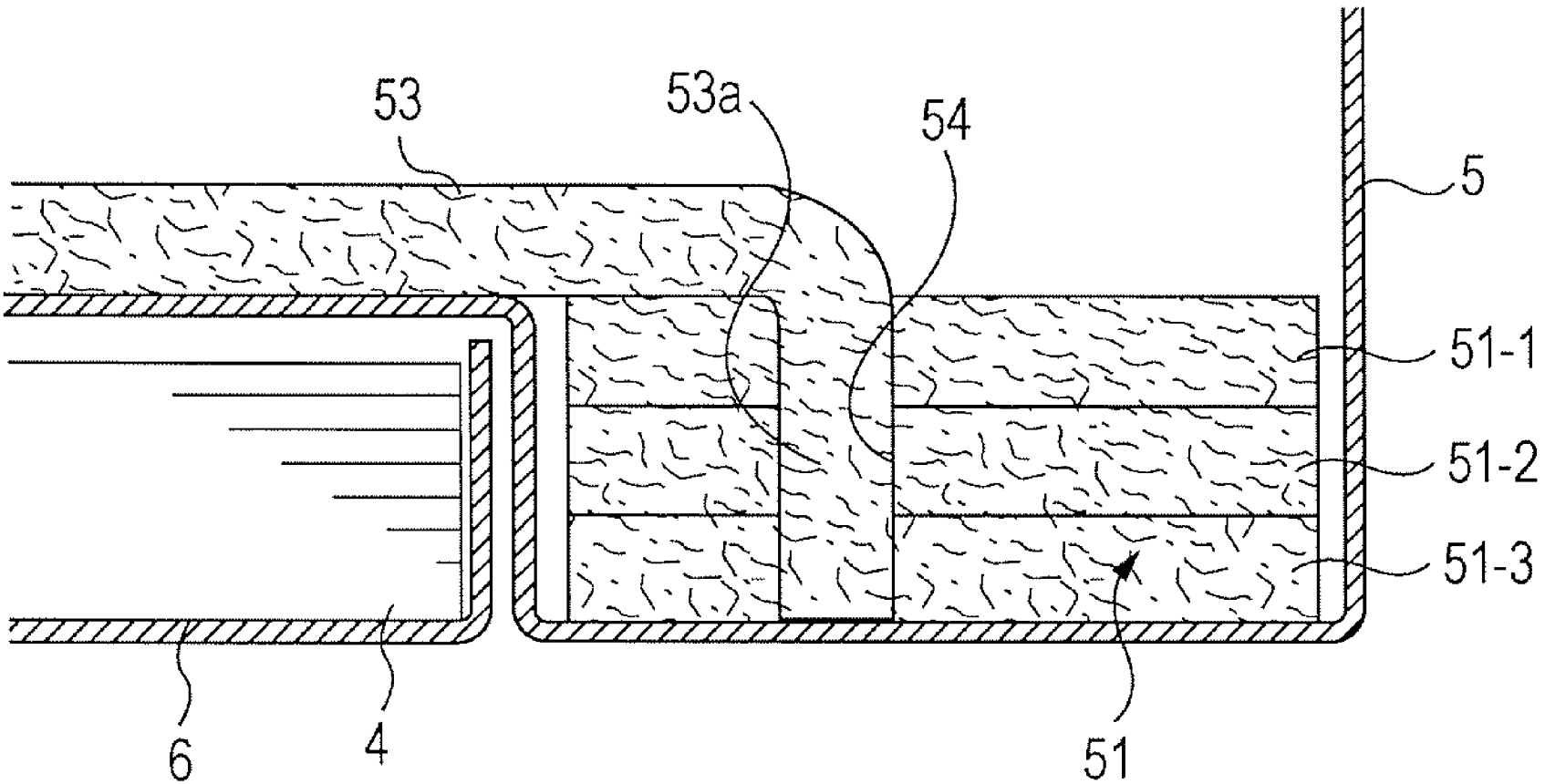
FIG. 5 is a fragmentary sectional view showing a first embodiment of the joint between an ink-retrieving absorber and a connecting absorber of a waste ink container of an ink jet recording apparatus according to the present invention.

FIG. 5 is a fragmentary sectional view showing the structure of a first embodiment of the joint between a connecting absorber and an ink-retrieving absorber. Although FIG. 5 shows the joint between the connecting absorber 53 and the first absorber 51, the joint between the connecting absorber 53 and the second absorber 52 has substantially the same structure. In FIG. 5, the connecting absorber 53 has substantially perpendicularly bent portions 53*a* and 53*b* (53*b* is not shown) formed at both ends thereof. A hole 54 is formed through all of the layers of absorbing members 51-1, 51-2, and 51-3 of the first absorber 51. The bent portion 53*a* is inserted into the hole 54 through all of the layers of absorbing members.

Thus, the bent portion 53*a* is in contact with all of the layers of absorbing members 51-1, 51-2, and 51-3. In this case, the absorption and spread of waste ink can be promoted by increasing the cross-sections of the bent portion 53*a* and the hole 54 so as to secure a sufficient contact area. In this embodiment, as is clear from the shown structure, the hole 54 has an elongated rectangular cross-section having a length corresponding to the width of the connecting absorber 53. The structure of the joint in the second absorber 52 is substantially the same as the structure shown in FIG. 5.

In the above structure, when the waste ink discharged from the recovery device 2 is introduced into the hole 54 from the exit tube 25*b*, the waste ink is absorbed by all of the layers of absorbing members 51-1, 51-2, and 51-3. At the same time, the waste ink diffuses from the lowermost absorbing member 51-3 to the middle absorbing member 51-2, and then diffuses from the middle absorbing member 51-2 to the uppermost absorbing member 51-1. At the same time, the waste ink is also absorbed by the connecting absorber 53 through the bent portion 53*a* and diffused into the connecting absorber 53. At substantially the same time, the waste ink absorbed and diffused into the connecting absorber 53 is transmitted to absorbing members 52-1, 52-2, and 52-3 of the other absorber (second absorber) 52 and is absorbed and diffused into these absorbing members.

In the waste ink container 50 described with reference to FIGS. 1 to 5, the ink-retrieving absorbers 51 and 52 have a multilayer structure of absorbing members. Utilizing the spaces in the apparatus body efficiently, the waste ink container 50, the separating and feeding device 41 including sheets 4, and the conveying device (43 and 44) are disposed. Since the spaces are utilized efficiently, the absorption capacity of waste ink can be increased without increasing the recording apparatus in size. Therefore, even when a large amount of waste ink is discharged at a time, the waste ink can be absorbed in a short time. In addition, since the ink-retrieving absorbers are connected not by a communicating mechanism such as a tube formed of a different material but by an absorber, the above advantageous effects can be achieved with ease and at low cost.

Generally, recording apparatuses require areas where a reciprocating carriage accelerates or decelerates on either side of the image forming area. In ink jet recording apparatuses, a recovery device is disposed at a position adjacent the image forming area. For these reasons, there can be unused spaces on either side of the recording apparatus body. Therefore, if the waste ink container according to this embodiment is adopted, since the ink-retrieving absorbers are disposed, utilizing these spaces, the above advantageous effects can be achieved more efficiently.

Figure 8:
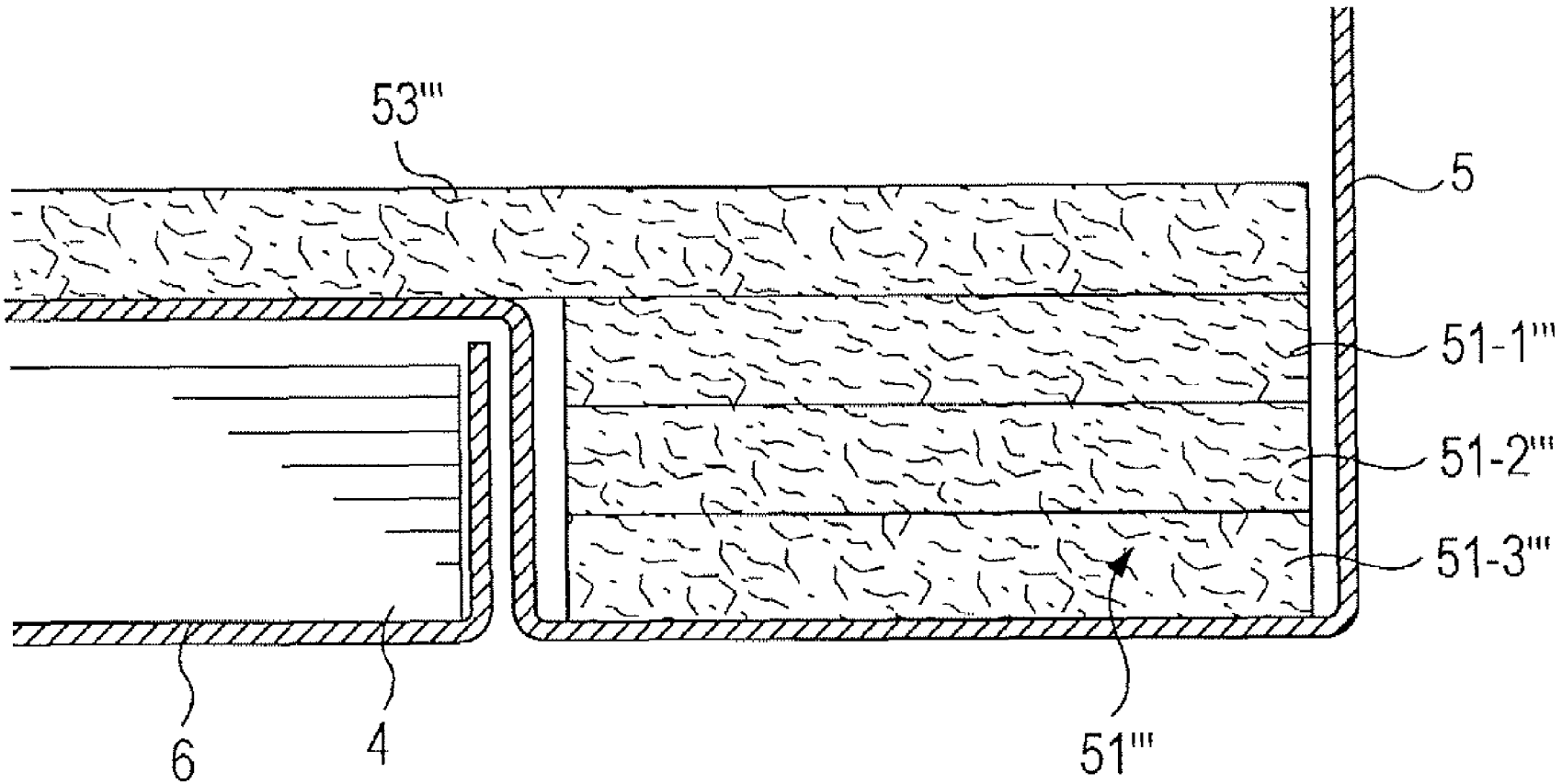
FIG. 8 is a fragmentary sectional view showing a reference example of the joint between an ink-retrieving absorber and a connecting absorber of a waste ink container of an ink jet recording apparatus.

FIG. 8 is a fragmentary sectional view showing a reference example that differs from this embodiment in that the connecting absorber 53''' that connects the ink-retrieving absorbers 51''' and 52''' is not provided with the bent portions 53*a* and 53*b*. In the embodiment shown in FIG. 5, the ends of the connecting absorber 53 are bent, and these bent portions are in contact with the absorbing members constituting the multilayered ink-retrieving absorbers 51 and 52. Therefore, compared to the structure of FIG. 8, the speed at which the introduced waste ink is absorbed and diffused can be dramatically improved. Therefore, even when a large amount of waste ink is discharged at a time, the waste ink can be absorbed in a short time, and the waste ink container can be more efficiently prevented from overflowing.

Embodiment 2

Figure 6:
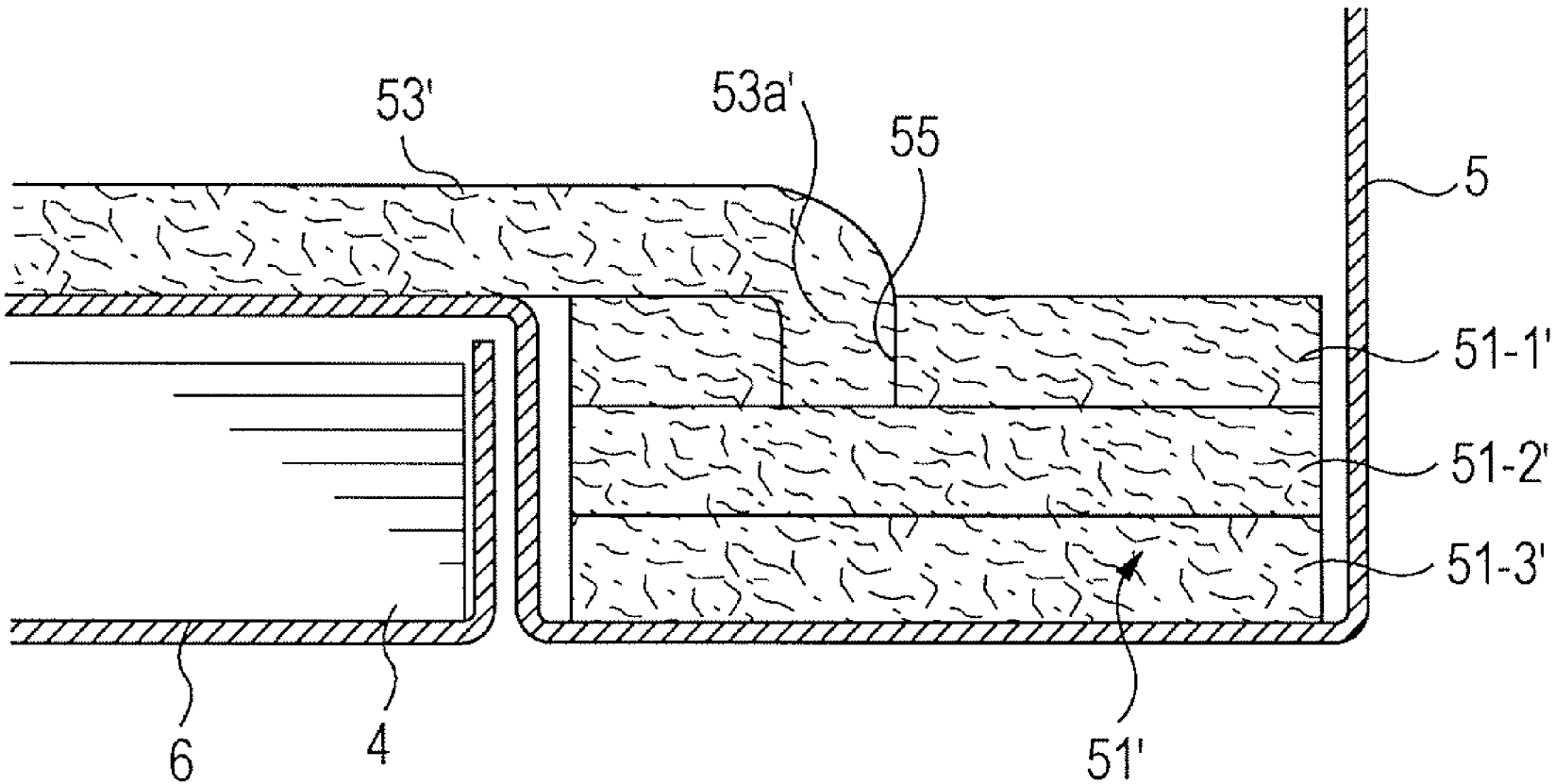
FIG. 6 is a fragmentary sectional view showing a second embodiment of the joint between an ink-retrieving absorber and a connecting absorber of a waste ink container of an ink jet recording apparatus according to the present invention.

FIG. 6 is a fragmentary sectional view showing the structure of a second embodiment of the joint between a connecting absorber and an ink-retrieving absorber. Although FIG. 6 shows only the joint between the connecting absorber 53' and the first absorber 51', the joint between the connecting absorber 53' and the second absorber 52' has substantially the same structure. In FIG. 6, the connecting absorber 53' has substantially perpendicularly bent portions 53*a'* and 53*b'* (53*b'* is not shown) formed at both ends thereof. A hole 55 is formed through only the first layer of absorbing member 51-1' of the first absorber 51'. In this embodiment, the bent portion 53*a'* is inserted into the hole 55 through only the first layer of absorbing member 51-1'. Thus, the bent portion 53*a'* is in contact with the first and second layers of absorbing members 51-1' and 51-2'. The bent portion 53*a'* may be in contact with only the first layer of absorbing member 51-1'. This embodiment differs from Embodiment 1 in the above respects, but in other respects, this embodiment is substantially the same as Embodiment 1. Also in Embodiment 2, the same advantageous effects as in Embodiment 1 can be obtained.

Embodiment 3

Figure 7:
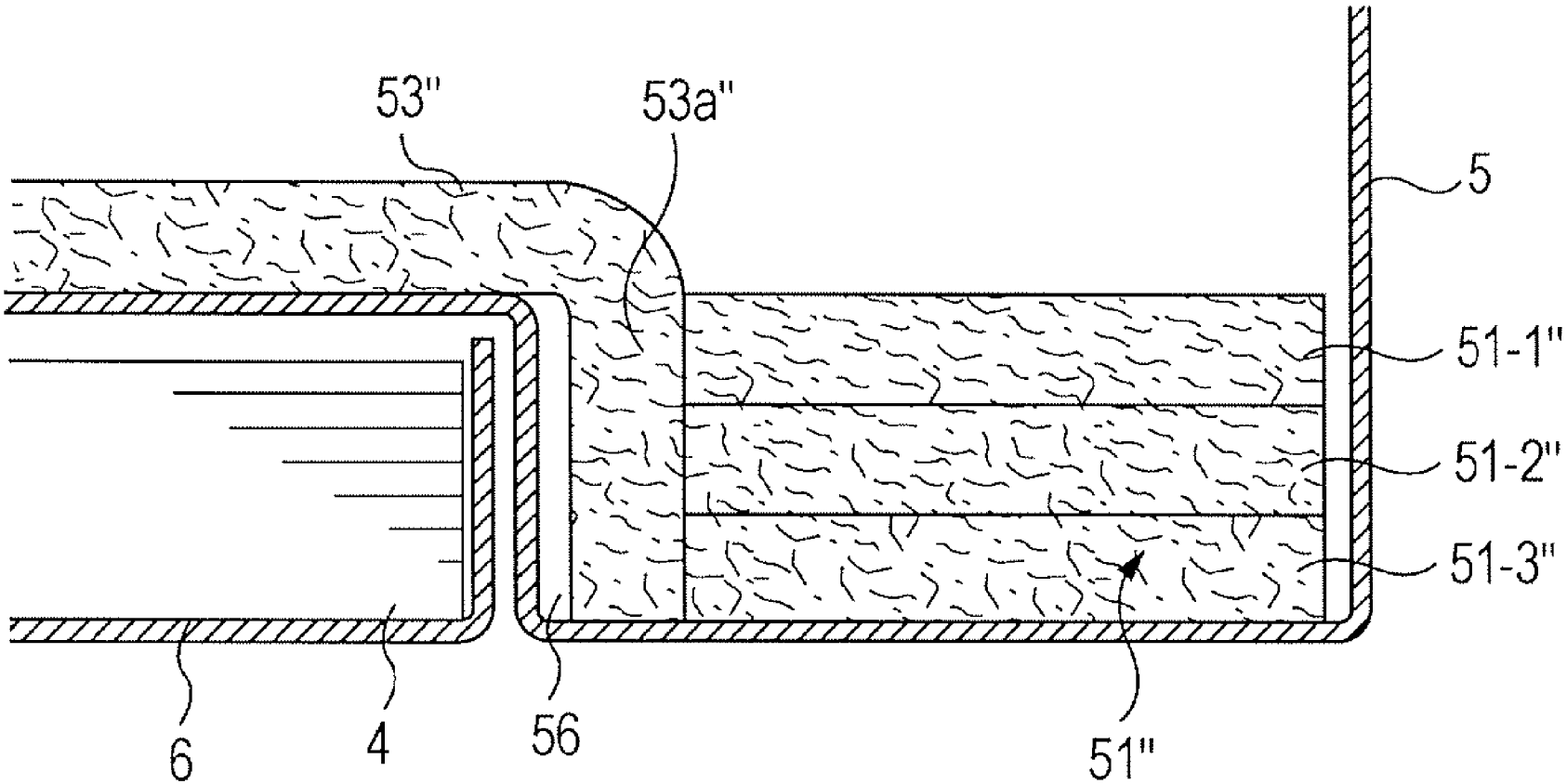
FIG. 7 is a fragmentary sectional view showing a third embodiment of the joint between an ink-retrieving absorber and a connecting absorber of a waste ink container of an ink jet recording apparatus according to the present invention.

FIG. 7 is a fragmentary sectional view showing the structure of a third embodiment of the joint between a connecting absorber and an ink-retrieving absorber. Although FIG. 7 shows the joint between the connecting absorber 53" and the first absorber 51", the joint between the connecting absorber 53" and the second absorber 52" has substantially the same structure. In FIG. 7, the connecting absorber 53" has substantially perpendicularly bent portions 53*a"* and 53*b"* (53*b"* is not shown) formed at both ends thereof. A space or a groove 56 is defined between the inner surface of the side wall of the container portion formed in the case 5 and the side surfaces of all of the layers of absorbing members 51-1", 51-2", and 51-3" of the first absorber 51". In this embodiment, the bent portion 53*a*" is inserted in the space or groove 56 defined between the inner surface of the side wall of the container portion formed in the case 5 and the side surfaces of all of the layers of absorbing members 51-1", 51-2", and 51-3" of the first absorber 51". Thus, the bent portion 53*a*" is in contact with all of the layers of absorbing members 51-1", 51-2", and 51-3". This embodiment differs from Embodiment 1 in the above respects, but in other respects, this embodiment is substantially the same as Embodiment 1. Also in Embodiment 3, the same advantageous effects as in Embodiment 1 can be obtained.

In the above embodiments, two ink-retrieving absorbers 51 and 52 are disposed on either side of the recording apparatus body. The present invention can also be applied to the case where two or more ink-retrieving absorbers are disposed at desired positions in the recording apparatus body. In that case, the same advantageous effects can be obtained. In the above embodiments, each ink-retrieving absorber has a three-layer structure including three layers of absorbing members. However, the number of layers may be two or four or more. Although, in the above embodiments, the connecting absorber 53 has a single-layer structure, the connecting absorber 53 may have a multilayer structure if necessary.

In the above embodiments, the waste ink discharged from the recovery device 2 is absorbed by the waste ink container 50. The present invention can also be applied to the case where the waste ink leaking or overflowing from portions other than the recovery device such as the ink tank and the recording head is absorbed by the waste ink container. In that case, the same advantageous effects can be obtained. In the above embodiments, the cassette 6 for feeding sheets is disposed in the lower center of the recording apparatus. In addition to this, a discharge tray for receiving sheets discharged after recording may be disposed in the lower center of the recording apparatus.

In the above embodiments, a serial-type recording apparatus including a recording head mounted on a carriage is taken as an example. The present invention can also be applied to a line-type recording apparatus that performs recording with sub-scanning only. In that case, the same advantageous effects can be obtained. In addition, the present invention can be applied to any ink jet recording apparatus regardless of the number of recording heads, or the type of ink. In that case, the same advantageous effects can be obtained.

The embodiments of the present invention provide an ink jet recording apparatus including a waste ink container that has an increased capacity without increasing the recording apparatus in size and that, even when a large amount of waste ink is discharged at a time, can absorb the waste ink in a short time.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2005-290037 filed Oct. 3, 2005, which is hereby incorporated by reference herein in its entirety.

What is claimed is:

1. An ink jet recording apparatus that discharges ink from a recording device onto a recording medium and thereby performs recording, the apparatus comprising:

a recovery device for maintaining or recovering an ink-discharging function of the recording device;

a first absorber that absorbs waste ink discharged from said recovery device;

a second absorber that is disposed apart from said first absorber and absorbs the waste ink; and a connecting absorber that transmits ink from said first absorber to said second absorber, wherein said connecting absorber is in contact with at least one fast surface of said first absorber, through which ink spreads faster than ink spreads in other surfaces of said first absorber, wherein said connecting absorber comprises a bent portion, and the bent portion is in contact with the at least one fast surface of said first absorber.

2. The ink jet recording apparatus according to claim 1, wherein the at least one fast surface of said first absorber is a surface in the thickness direction of said first absorber.

3. The ink jet recording apparatus according to claim 1, wherein at least one slow surface of the bent portion, through which ink spreads slower than in other surfaces of the bent portion, is in contact with the at least one fast surface of said first absorber.

4. The ink jet recording apparatus according to claim 3, wherein at least one of the other surfaces of the bent portion, through which ink spreads faster than in the at least one slow portion of the bent portion, is in contact with at least one of the other surfaces of said first absorber, through which ink spreads slower than in the fast surface of said first absorber.

5. The ink jet recording apparatus according to claim 1, wherein said first absorber comprises a multilayer structure including a plurality of absorbing members, and the bent portion is in contact with a fast surface of at least one of the absorbing members.

6. The ink jet recording apparatus according to claim 5, wherein the bent portion is in contact with a fast surface of all of the absorbing members.

7. The ink jet recording apparatus according to claim 1, wherein said first absorber has a hole formed therein, and the bent portion is inserted into the hole.

8. The ink jet recording apparatus according to claim 1, wherein the bent portion is inserted into a groove so as to abut a side of said first absorber.

9. The ink jet recording apparatus according to claim 1, wherein said connecting absorber is in contact with at least one fast surface of said second absorber, through which ink spreads faster than ink spreads in other surfaces of said second absorber.

10. An ink jet recording apparatus that discharges ink from a recording device onto a recording medium and thereby performs recording, the apparatus comprising:

recovery means for maintaining or recovering an ink-discharging function of the recording device;

first absorbing means for absorbing waste ink discharged from said recovery means;

second absorbing means, disposed apart from said first absorbing means, for absorbing the waste ink; and connecting absorbing means for transmitting ink from said first absorbing means to said second absorbing means, wherein said connecting absorbing means is in contact with a fast surface of said first absorbing means, through which ink spreads faster than ink spreads in other surfaces of said first absorbing means, wherein said connecting absorbing means comprises a connecting means, and the connecting means is in contact with the fast surface of said first absorbing means, and wherein at least one slow surface of the connecting means, through which ink spreads slower than other surfaces of the connecting means, is in contact with the fast surface of said first absorbing means.

11. The ink jet recording apparatus according to claim 10, wherein the fast surface of said first absorbing means is a surface in the thickness direction of said first absorbing means.

12. The ink jet recording apparatus according to claim 10, wherein at least one of the other surfaces of the connecting means is in contact with at least one of the other surfaces of said first absorbing means.

13. The ink jet recording apparatus according to claim 10, wherein said first absorbing means comprises a multilayer structure including a plurality of discrete absorbing means, and the connecting means is in contact with a fast surface of at least one of the discrete absorbing means.

14. The ink jet recording apparatus according to claim 13, wherein the connecting means is in contact with a fast surface of all of the discrete absorbing means.

15. The ink jet recording apparatus according to claim 10, wherein said first absorbing means has a hole formed therein, and the connecting means is inserted into the hole.

16. The ink jet recording apparatus according to claim 10, wherein the connecting means is inserted into a groove so as to abut a side of said first absorbing means.

17. The ink jet recording apparatus according to claim 10, wherein said connecting absorbing means is in contact with at least one surface of said second absorbing means, through which ink spreads faster than ink spreads in other surfaces of said second absorbing means.

18. An ink jet recording apparatus that discharges ink from a recording device onto a recording medium and thereby performs recording, the apparatus comprising:

a recovery device for maintaining or recovering an ink discharging function of the recording device;

a first absorber that absorbs waste ink discharged from said recovery device;

a second absorber that is disposed apart from said first absorber and absorbs the waste ink; and a connecting absorber that transmits ink from said first absorber to said second absorber, wherein said connecting absorber is in contact with at least one fast surface of said second absorber, through which ink spreads faster than ink spreads in other surfaces of said second absorber, and wherein said connecting absorber comprises a bent portion, and the bent portion is in contact with the at least one fast surface of said second absorber.

19. The ink jet recording apparatus according to claim 18, wherein the at least one fast surface of said second absorber is a surface in the thickness direction of said second absorber.

20. The ink jet recording apparatus according to claim 18, wherein at least one slow surface of the bent portion, through which ink spreads slower than in other surfaces of the bent portion, is in contact with at least one fast surface of said second absorber.

21. The ink jet recording apparatus according to claim 20, wherein at least one of the other surfaces of the bent portion, through which ink spreads faster than in the at least one slow portion of the bent portion, is in contact with at least one of the other surface of said second absorber, through which ink spreads slower than in the fast surface of said second absorber.

22. The ink jet recording apparatus according to claim 18, wherein said second absorber comprises a multilayer structure including a plurality of absorbing members, and the bent portion is in contact with a fast surface of at least one of the absorbing members.

23. The ink jet recording apparatus according to claim 18, wherein said second absorber has a hole formed therein, and the bent portion is inserted into the hole.

* * * * *